US006304518B1

(12) United States Patent
O'Neill

(10) Patent No.: US 6,304,518 B1
(45) Date of Patent: Oct. 16, 2001

(54) CLOCKWORKS, TIMEPIECE AND METHOD FOR OPERATING THE SAME

(75) Inventor: Terrence J. O'Neill, Lake Geneva, WI (US)

(73) Assignee: Quartex division of Primex Inc., Lake Geneva, WI (US)

( * ) Notice: Subject to any disclaimer, the term of this patent is extended or adjusted under 35 U.S.C. 154(b) by 25 days.

(21) Appl. No.: 09/645,974

(22) Filed: Sep. 12, 2000

Related U.S. Application Data

(63) Continuation of application No. 09/291,142, filed on Apr. 12, 1999, now abandoned.

(51) Int. Cl.[7] ..... G04C 11/02

(52) U.S. Cl. ..... 368/47; 368/184; 368/187

(58) Field of Search ..... 368/47, 52, 60, 368/80, 185, 187, 59

(56) References Cited

U.S. PATENT DOCUMENTS

| | | | |
|---|---|---|---|
| 3,911,665 | 10/1975 | van Berkum | 58/50 R |
| 3,945,191 | 3/1976 | van Berkum | 58/4 A |
| 4,014,166 | 3/1977 | Cateora et al. | 58/26 R |
| 4,023,344 | 5/1977 | Mukaiyama | 58/35 W |
| 4,204,398 | 5/1980 | Lemelson | 58/47 |
| 4,650,344 | 3/1987 | Allgaier et al. . | |
| 5,036,500 | 7/1991 | Ganter | 368/47 |
| 5,077,706 | 12/1991 | Ganter | 368/47 |
| 5,151,885 | 9/1992 | Kasuo . | |
| 5,231,612 | 7/1993 | Allgaier et al. | 368/47 |
| 5,329,501 | 7/1994 | Meister et al. | 368/10 |
| 5,349,570 | 9/1994 | Kaiser . | |
| 5,363,348 | 11/1994 | Damle | 368/47 |
| 5,671,192 | 9/1997 | Schaffel | 368/47 |

FOREIGN PATENT DOCUMENTS

| | | |
|---|---|---|
| 1277763 | 12/1968 | (DE) . |
| 3043867 | 1/1982 | (DE) . |
| 4008898 | 3/1990 | (DE) . |
| 0204851 | 8/1985 | (EP) . |
| 0372432 | 2/1989 | (EP) . |
| 0374745 | 12/1989 | (EP) . |
| 62-135791 | 6/1987 | (JP) . |
| 63-309889 | 12/1988 | (JP) . |
| 2-218993 | 8/1990 | (JP) . |
| 4-208897 | 7/1992 | (JP) . |
| 5-264752 | 10/1993 | (JP) . |

*Primary Examiner*—Diego Gutierrez
*Assistant Examiner*—Jeanne-Marguerito Goodwin
(74) *Attorney, Agent, or Firm*—Michael Best & Friedrich LLP

(57) ABSTRACT

A clockworks, a timepiece and a method for operating a timepiece. The timepiece comprises a housing providing a face, the face having indicators corresponding to respective time increments, a plurality of hands rotatably supported on the face, the plurality of hands being rotatably positionable relative to the indicators to indicate a time, one of the plurality of hands being a sweep hand, and the clockworks supported by the housing. The clockworks includes a drive mechanism supported by the housing and connectable to the plurality of hands to rotatably drive the plurality of hands, the drive mechanism being connectable to a power source operable to power the drive mechanism, a time register to store information corresponding to the time indicated by the plurality of hands, a switch member connected with the time register, the switch being operated when the sweep hand rotates by one of the indicators and when the sweep hand rotates by an other one of the plurality of hands to provide the information to the time register corresponding to the time indicated by the plurality of hands, means for receiving a broadcast time signal, means for comparing information corresponding to a broadcast time represented by the broadcast time signal to the information corresponding to the time indicated by the plurality of hands, and means for synchronizing the time indicated by the plurality of hands to the broadcast time.

26 Claims, 2 Drawing Sheets

CLOCKWORKS, TIMEPIECE AND METHOD FOR OPERATING THE SAME

This application is a continuation of patent application Ser. No. 09/291,142, filed on Apr. 12, 1999.

BACKGROUND OF THE INVENTION

The present invention relates to clockworks and timepieces and, more particularly, to a mechanism for aligning or synchronizing the hands in an analog timepiece.

A typical analog timepiece, such as a clock, includes a housing providing a clock face or dial having time indicators, a plurality of hands rotatably supported on the clock face and positionable relative to the indicators to indicate a time, and an analog clockworks for controlling the position and movement of the hands. The clockworks includes a mechanism for setting the hands in respective rotational positions to indicate a time and a drive mechanism supported by the housing and connectable to the hands to rotatably drive the hands. The drive mechanism is connectable to a power source, such as a AA battery, which is operable to power the drive mechanism.

The clock industry has developed a standard size for a quartz analog clockworks unit. The standard-sized unit is 56 mm wide by 56 mm high by 17 mm thick. In this unit, the battery is located horizontally at the bottom of and is accessible from the back of the unit. Output shafts of the drive mechanism are centrally located on the front side of the unit. The standard unit also has two ledges (15 mm wide), one on the top of the unit and the other on the bottom of the unit. The ledges enable the unit to be snapped into the clock housing and held in place. This snap-in feature is used by most major clock companies as part of the clock assembly process.

For a standard analog timepiece, a mechanism is required for the initial alignment or positioning of the hands relative to the indicators on the face so that the hands display the correct time. Typically, this mechanism is a mechanical set button which adjusts the positions of the hands relative to the indicators. After the initial positioning or setting of the hands, the regulated drive mechanism moves the hands so that the hands continue to display the correct time.

Another type of analog timepiece is a remotely- controlled (i.e., radio-controlled) analog timepiece. Such a clock includes a clockworks capable of driving the hands to display a time corresponding to a broadcast time signal. To do so, this clockworks typically includes a drive mechanism for driving the hands, a receiver for receiving the broadcast time signal, means for comparing information corresponding to a broadcast time represented by the broadcast time signal to information corresponding to the local time indicated by the hands, and means for synchronizing the time indicated by the hands to the broadcast time.

For the remotely-controlled timepiece to display the correct time, a mechanism is required to align or synchronize the respective positions of the hands (the local time) with electronic information corresponding to these positions. In general, these remotely-controlled timepieces may be fully-automatic (no operator adjustment required to align the hands) or semi-automatic (some operator adjustment required to align the respective positions of the hands with the electronic information corresponding to these positions).

U.S. Pat. No. 5,231,612, which issued to Allgaier et al., discloses a radio-controlled timepiece including a fully-automatic mechanism for the detection and correction of a hand setting. The mechanism includes components for sending and receiving a radiation beam, respectively. A hand setting mechanism includes an hour wheel, a minute wheel and a seconds wheel, each having an aperture. The hour wheel has a front mirror for reflecting the beam to the receiver. The beam to a rear mirror is passed through the front mirror to such that the beam is reflected by the rear mirror only after passing through the aligned apertures and discs. With this mechanism, the position of the hands may be automatically determined and corrected.

U.S. Pat. No. 5,671,192, which issued to Schaffel, discloses a semi-automatic radio-controlled, analog display clockworks. The clockworks includes a hand or pointer setting arrangement for the user to bring the pointers to a predetermined position corresponding to a certain time. Starting from this predetermined position, the control device applies control signals to the drive arrangement, causing the pointers to move more quickly until they are in a position corresponding to the broadcast time represented by the broadcast time signal.

SUMMARY OF THE INVENTION

One of the problems with the above-described radio-controlled analog clocks is that, because of the additional components required to control and operate the radio-controlled clock, these radio-controlled clockworks do not fit in the standard-sized housing of a standard quartz analog clockworks. As a result, the radio-controlled clockworks are not substitutable for the standard quartz clockworks. Also, the designs and manufacturing processes for standard quartz clocks must be modified to accommodate the oversized radio-controlled clockworks.

Another problem with the clockworks described in both U.S. Pat. Nos. 5,231,612 and 5,671,192 is that, because the hands are not set in a position relatively close to the actual time, the clocks may display the incorrect time during an extended correction period. This problem may be further aggravated and the period further extended by poor signal receiving conditions preventing the time display from being corrected.

Yet another problem with the clockworks described in U.S. Pat. No. 5,231,612 is that the optical components of the hand detection and position correction mechanism significantly increase the size and cost of the clockworks unit.

A further problem with the clockworks described in U.S. Pat. No. 5,231,612 is that, if the hands are removed from the clockworks (i.e., for repair), the optical components, including the wheels, must be optically realigned before the hands can be replaced in the correct position. This realignment procedure is time intensive and adds a costly delay to a repair or reassembly procedure for these clockworks.

Another problem with the clockworks described in U.S. Pat. No. 5,231,612 is that, if the clockworks are jarred during shipping, handling or use, the position of the hands may be shifted with respect to the optical components. This can misalign the clockworks, resulting in the clockworks keeping inaccurate time.

Yet another problem with the clockworks described in U.S. Pat. No. 5,671,192 is that, if the user inadvertently positions the pointers in a position which does not correspond to the predetermined position (i.e., the operator sets the pointers to a position that is 5 minutes from the predetermined position), the radio-controlled clockworks will continue to operate and display time with this operator-programmed positional error (5 minutes from the broadcast time) even after the local time is "synchronized" with the broadcast time.

A further problem with the clockworks described in U.S. Pat. No. 5,671,192 is that, because the radio-controlled clockworks is set much like a standard quartz clockworks (in which the user positions the hands in positions corresponding to the current local time), the user might inadvertently position the pointers in a position corresponding to the current local time rather than in the predetermined position. Again, the radio-controlled clockworks will continue to operate and display time with this operator-programmed positional error even after the local time is "synchronized" with the broadcast time.

To alleviate the problems with the above-described clockworks and timepieces, the present invention provides a clockworks, a timepiece and a method for operating a timepiece. The invention provides a clockworks in which the rotational position of the hands may be quickly and easily aligned or synchronized with the electronic information in the local time register. Also, this information may be more accurately aligned with the time register. Further, the clockworks does not include additional optical components, reducing the size and cost of the clockworks. In addition, the clockworks are sized to fit in the housing for a standard quartz analog clockworks and to be substitutable with the standard quartz analog clockworks.

The present invention provides a clockworks for use in a timepiece, the timepiece including a housing providing a face having indicators corresponding to respective time increments and plurality of hands rotatably supported on the face. The plurality of hands are rotatably positionable relative to the indicators to indicate a time, and one of the hands is a sweep hand.

The clockworks comprises a drive mechanism supported by the housing and connectable to the plurality of hands to rotatably drive the plurality of hands, the drive mechanism being connectable to a power source operable to power the drive mechanism, a time register to store information corresponding to the time indicated by the plurality of hands, and a switch member connected with the time register. The switch is operated when the sweep hand rotates by one of the indicators and when the sweep hand rotates by another one of the plurality of hands to provide the information to the time register corresponding to the time indicated by the plurality of hands.

Preferably, the switch is operable by an operator. Also, the other one of the plurality of hands is preferably a minute hand, and the switch is operated when the sweep hand rotates by the minute hand. In one construction, the operator sets the hour hand in a rotational position, and the switch is only operated when the sweep hand rotates by the minute hand to provide the information to the time register corresponding only to the time indicated by the minute hand. In another construction, the switch may also be operated when the sweep hand rotates by the hour hand to provide the information to the time register corresponding to the time indicated by both the minute hand and the hour hand.

The clockworks further preferably comprises a receiver for receiving a broadcast time signal, a mechanism for comparing information corresponding to a broadcast time represented by the broadcast time signal to the information corresponding to the time indicated by the plurality of hands, and a mechanism for synchronizing the time indicated by the plurality of hands to the broadcast time. The clockworks may also include an operator signaling mechanism operable to provide a representation of the broadcast time signal being received. Preferably, the switch is operable to selectively deactivate the operator signaling mechanism.

Preferably, the housing includes a cover portion of a standard size adapted to cover a standard clockworks, and the clockworks of the present invention is supported by the housing and covered by the standard-sized cover portion. Also, the clockworks of the present invention is preferably removably substitutable for standard quartz analog clockworks.

Further, the clockworks may preferably have a daylight savings mode, and the switch is operated to selectively deactivate the daylight savings mode. Preferably, as the power source is connected to the drive mechanism, the switch is operated to deactivate the daylight savings mode.

Also, the present invention provides a timepiece comprising the housing, the plurality of hands, and a clockworks supported by the housing. The clockworks includes the drive mechanism connected to the plurality of hands, the time register to store information corresponding to the time indicated by the plurality of hands, and the switch member connected with the time register. The switch is operated when the sweep hand rotates by one of the indicators and when the sweep hand rotates by another one of the plurality of hands to provide the information to the time register corresponding the time indicated by the plurality of hands. The clockworks also includes means for receiving a broadcast time signal, means for comparing information corresponding to a broadcast time represented by the broadcast time signal to the information corresponding to the time indicated by the plurality of hands, and means for synchronizing the time indicated by the plurality of hands to the broadcast time.

Further, the present invention provides a method for operating a timepiece comprising connecting the drive mechanism to the power source, operating the switch when the sweep hand rotates by one of the indicators, and operating the switch when the sweep hand rotates by another one of the plurality of hands to provide the information to the time register corresponding to the time indicated by the plurality of hands.

Preferably, the method further comprises receiving the broadcast time signal, comparing the information corresponding to the broadcast time to the information corresponding to the time indicated by the plurality of hands, and synchronizing the time indicated by the plurality of hands to the broadcast time. The method further preferably comprises operating the switch to selectively deactivate the daylight savings mode and/or the operator signaling mechanism.

One advantage of the present invention is that the clockworks may be housed in the standard-sized housing for a standard quartz analog clockworks. Further, the clockworks may be substitutable for the standard quartz analog clockworks.

Another advantage of the present invention is that, because the hands are set in a position approximately corresponding to the current local time, the clockworks does not display the incorrect time for an extended period during correction of the time display or in which the broadcast time signal is not received.

Yet another advantage of the present invention is that the clockworks does not include additional components which significantly increase the size and cost of the clockworks.

A further advantage of the present invention is that, if the hands are removed from the clockworks (i.e., for repair), the hands and the clockworks do not have to be realigned during reassembly of the clockworks. This alignment takes place during normal operation of the clockworks. The time and cost associated with repair and reassembly of the clockworks is thus greatly reduced.

Another advantage of the present invention is that, if the clockworks is jarred during shipping, handling or use, normal operation of the clockworks will correct any shifting in the position of the hands relative to the clockworks to insure that the clockworks are aligned and the time display is accurate.

Yet another advantage of the present invention is that, because the operator aligns the actual position of the hands with the local time register, rather than positioning the hands in a predetermined position corresponding to a preset value in the local time register, the operator is less likely to inadvertently position the hands or incorrectly indicate the position of the hands. The likelihood of an operator-programmed error is reduced, increasing the accuracy of the time indicated by the clockworks.

A further advantage of the present invention is that the clockworks is set much like the standard quartz analog clockworks (i.e., the hands are positioned to approximately the current local time), and the position of the hands at this approximate current local time is aligned with the local time register. As a result, an operator will not inadvertently set the position of the hands to a time that is different than the information stored in the local time register. Rather, the position of the hands will be aligned with the information stored in the local time register. Again, the likelihood of an operator-programmed error is reduced, increasing the accuracy of the time indicated by the clockworks.

Another advantage of the present invention is that, when the operator does not set the local time register, the clockworks will automatically operate to maintain the local time set by the operator. As a result, the clockworks keeps more accurate time than a standard clockworks. In this regard, the present invention is also useful in non-clock timekeeping equipment, i.e., for precise advancement of a time meter.

Other features and advantages of the invention will become apparent to those skilled in the art upon review of the following detailed description, claims and drawings.

Figure 1:
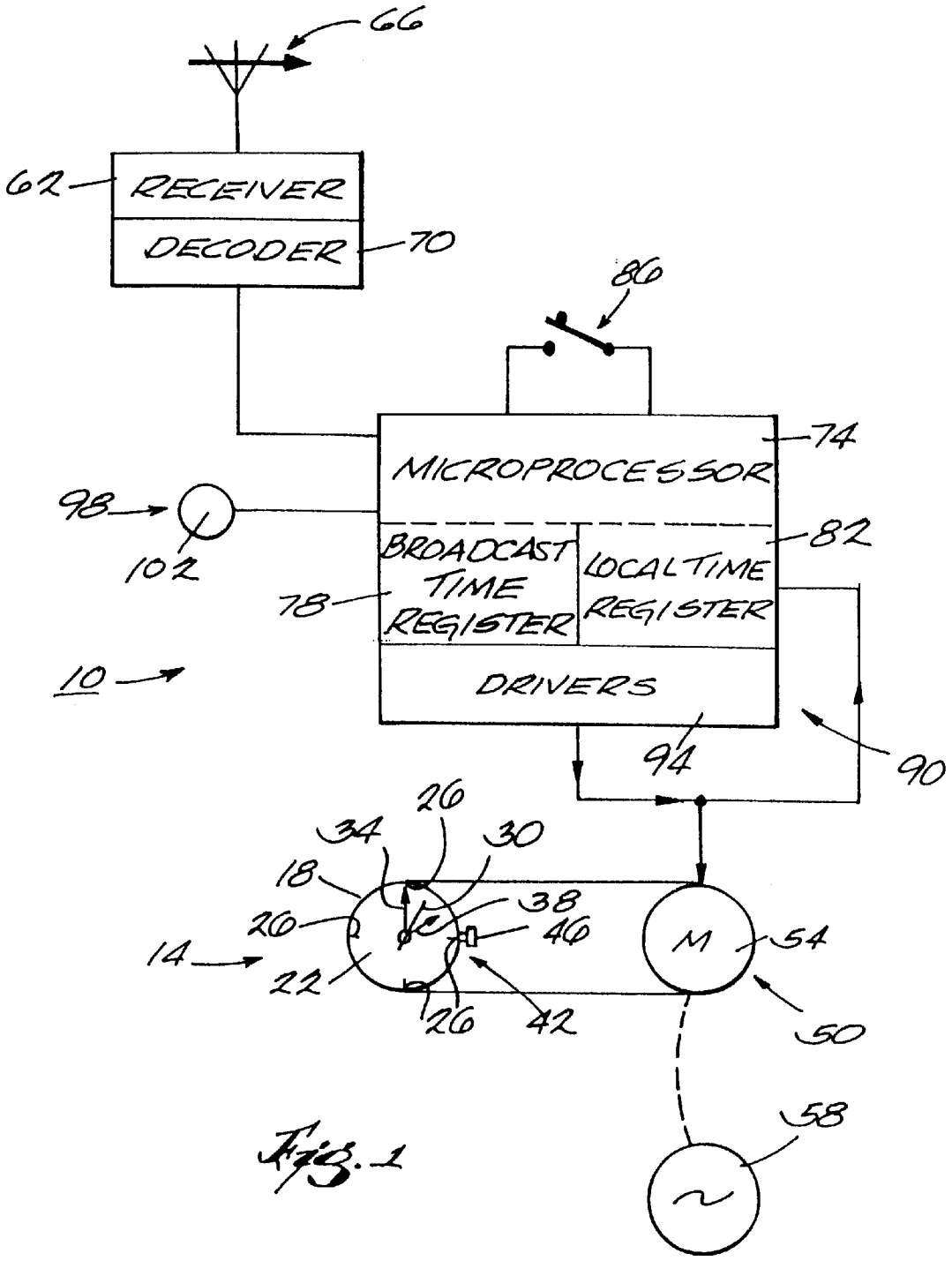
FIG. 1 is a partial schematic view illustrating the clockworks embodying the invention.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or carried out in various ways. Also, it is understood that phraseology and terminology used herein is for the purpose of the description and should not be regarded as limiting.

DETAILED DESCRIPTION OF THE PREFERRED EMBODIMENT

A clockworks 10 embodying the invention is partially schematically illustrated in FIG. 1. The clockworks 10 is for use in a timepiece, such as a clock 14 partially shown in FIG. 1), It should be understood, however, that the clockworks 10 may be used with any type of timepiece, i.e., clocks, watches, etc. Further, the clockworks 10 may be used in non-clock timekeeping equipment, i.e., for precise advancement of a time meter.

The clock 14 includes a housing 18 providing a dial or clock face 22 having indicators 26 corresponding to respective time increments. The clock 14 also includes a plurality of hands, namely, a sweep hand 30, a minute hand 34 and an hour hand 38, rotatably supported on the clock face 22. The hands 30, 34 and 38 are rotatably positionable relative to the indicators 26 to indicate a time (i.e., 2:00:05, as shown in FIG. 1). For purposes of discussion, the time indicated by the hands 30, 34 and 38 is referred to as the "local time".

The clockworks 10 includes a setting mechanism 42 for setting the hands 30, 34 and 38 in respective rotational positions. The setting mechanism 42 includes (see FIGS. 1 and 3) an adjustment button 46 connected to the hands 30, 34 and 38 to rotatably move the hands 30, 34 and 38 to respective rotational positions corresponding to a given local time. As explained below in more detail, when operating the clock 14, the operator preferably initially sets the hands 30, 34 and 38 in respective positions approximately corresponding to the current local time.

The clockworks 10 also includes (see FIGS. 1 and 2) a regulated drive mechanism 50 supported by the housing 18. The drive mechanism 50 rotatably drives the hands 30, 34 and 38 to correctly display time. Specifically, in the normal operating mode, the sweep hand 30 is rotatably driven to make a complete revolution every minute, the minute hand 34 to make a complete revolution every hour, and the hour hand 38 to make a complete revolution every 12 hours. As discussed below in more detail, the drive mechanism 50 also drives the hands 30, 34 and 38 to synchronize the local time displayed by the hands 30, 34 and 38 with a broadcast time.

Figure 2:
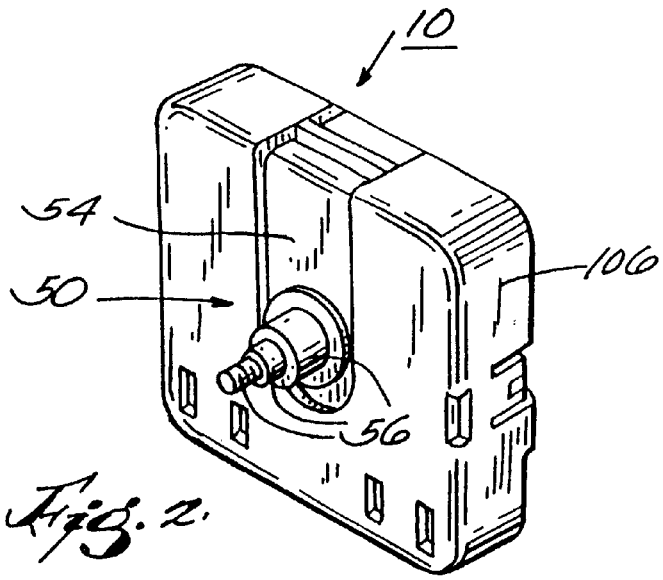
FIG. 2 is a front perspective view of the clockworks illustrated in FIG. 1.

The drive mechanism 50 includes a bi-polar stepper motor 54 connected to drive shafts 56 (see FIG. 2). The drive shafts 56 are respectively connectable with the hands 30, 34 and 38. A power source 58 (schematically shown in FIG. 1), such as a AA battery 60 (see FIG. 3), is connectable with the drive mechanism 50 to power the drive mechanism 50 and the clockworks 10. In other constructions (not shown), another type of power source may be used.

In the illustrated construction, the clockworks 10 is remotely-controlled and, preferably, radio-controlled, so that the time displayed by the hands 30, 34 and 38 corresponds to a broadcast time. It should be understood, however, that the clockworks 10 may be any type of remotely-controlled clockworks, i.e., radio-controlled clockworks, clockworks which are hard-wired to a remote time broadcasting station, etc. Further, it should be understood that, in some constructions (not shown), the clockworks 10 may not be remotely-controlled and that features of the clockworks 10 may be used with standard analog timepieces.

Because, in the illustrated construction, the clockworks 10 is remotely-controlled, the clockworks 10 also includes (see FIG. 1) a receiver 62 for receiving a broadcast time signal. The receiver 62 includes an antenna 66 tuned to the frequency of the broadcast time signal. The receiver 62 also includes a decoder 70 for demodulating the broadcast time signal into a pulse train.

The clockworks 10 also includes a microprocessor 74 for converting the information contained in the pulse train into a digital time format for the broadcast time represented by the broadcast time signal. The electronic information corresponding to the broadcast time is stored in a real time or broadcast time register 78.

The clockworks 10 also includes a local time register 82 to store information corresponding to the local time indicated by respective positions of the hands 30, 34 and 38. A switch 86 is connected with the local time register 82. The switch 86 aligns or synchronizes the local time indicated by the respective positions of the hands 30, 34 and 38 with electronic information representing these positions and stored in the local time register 82. As explained below, the switch member 86 also selectively activates and deactivates additional options for the clockworks 10.

The switch 86 is operated when the sweep hand 30 rotates by or crosses a predetermined one of the indicators 26, such as the indicator 26 representing the 12 o'clock position. In one construction, the switch 86 is also operated when the sweep hand 30 rotates by or crosses the minute hand 34. In this manner, the switch 86 provides to the local time register 82 electronic information corresponding to the time indicated by the positions of the hands 30 and 34.

In this construction and because the operator has initially positioned the hands 30, 34 and 38 to the approximate current local time, the operator has mechanically set the correct position for the hour hand 38. Accordingly, this position information is not required to be stored in the local time register 82 because the position of the hour hand 38 does not require correction.

Further, in this construction, the clockworks 10 does not require a mechanism for programming the time zone of the clock 14. By setting the hands 30, 34 and 38 to respective positions approximately corresponding to the current local time, the operator has mechanically set the correct hour offset between the local time zone and the time zone of the broadcast time signal.

In an alternate construction, the switch 86 would also be operated as the sweep hand 30 rotates by the hour hand 38 to also provide this information to the local time register 82. This position information would also be stored in the local time register 82, and the position of the hour hand 38 would also be correctable. In this alternate construction, the clockworks 10 would include a mechanism (not shown) for programming the time zone offset between the local time zone and the time zone of the broadcast time signal. Further, in this alternate construction (not shown), the hands 30, 34 and 38 would not have to be positioned to the current local time, and no mechanical setting mechanism would be required.

In the illustrated construction, the switch 86 has an open or non-operated position (shown in solid lines in FIG. 1) and a closed or operated position (shown in phantom in FIG. 1), and the switch 86 is manually operated by an operator. In other constructions (not shown), the switch 86 may operate automatically when the sweep hand 30 rotates by the indicator 26 and by the hands 34 and/or 38. Further, in other constructions (not shown), another device may, in a similar manner, be used to provide the position information to the local time register 82, and such a device may be manually-operated or automatic.

The clockworks 10 also includes a mechanism 90 for synchronizing the time indicated by the plurality of hands 30, 34 and 38 to the broadcast time. The synchronizing mechanism 90 includes the microprocessor 74, which operates as a mechanism for comparing the information stored in the broadcast time register 78 (corresponding to the broadcast time represented by the broadcast time signal) to information in the local time register 82 (corresponding to the local time indicated by the hands 30, 34 and 38). The microprocessor 74 compares the information in the broadcast time register 78 to the information in the local time register 82 to determine whether or not the broadcast time and the local time are synchronized.

The synchronizing mechanism 90 also includes a driver 94 which controls the motor 54. If the information in the broadcast time register 78 does not agree with the information in the local time register 82 (i.e., the information in the registers 78 and 82 is not synchronized), the microprocessor 74 adjusts the pulses from the driver 94 to the motor 54 to advance the hands 30, 34 and 38 into agreement with the broadcast time (represented by the information in the broadcast time register 78). The microprocessor 74 also advances the information in the local time register 82 to agree with the information in the broadcast time register 78.

Also, if the switch 86 is not operated to set the local time register 82 within a given time (i.e., fifteen minutes) after the clockworks 10 has begun to operate, the microprocessor 74 will automatically synchronize the information in the local time register 82 with the information in the broadcast time register 18. The microprocessor 74 will assume that the operator has set the clockworks 10 to the desired local time.

In this case, the clockworks 10 will operate to maintain this desired local time. The local time register 82 will advance at the same rate as the hands 30, 34 and 38. If, later, the local time register 82 is not synchronized with the broadcast time register 78, the clockworks 10 will operate to synchronize the registers 78 and 82 and advance the hands 30, 34 and 38. In this manner, the clockworks 10 will maintain the local time more accurately than a standard quartz clockworks. Such operation is also particularly useful in the non-clock timekeeping equipment.

In the illustrated radio-controlled clockworks, the clockworks 10 also includes an operator signaling mechanism 98 for providing to the operator a representation of the broadcast time signal being received. This signal helps the operator locate optimal positions and orientations for the clock 14 to provide better reception of the broadcast time signal.

In the illustrated construction, the operator signaling mechanism 98 includes a beeper 102 which provides an audible signal to the operator representing the strength of the broadcast time signal. A similar operator signaling mechanism is shown and described in U.S. patent application Ser. No. 09/192,896, filed Nov. 11, 1998, which is incorporated herein by reference. In other constructions (not shown), the operator signaling mechanism 98 may provide to the operator a different signal, such as a visual or tactile signal, to represent the strength of the broadcast signal. The switch 86 is operable to selectively deactivate the beeper 102.

Figure 3:
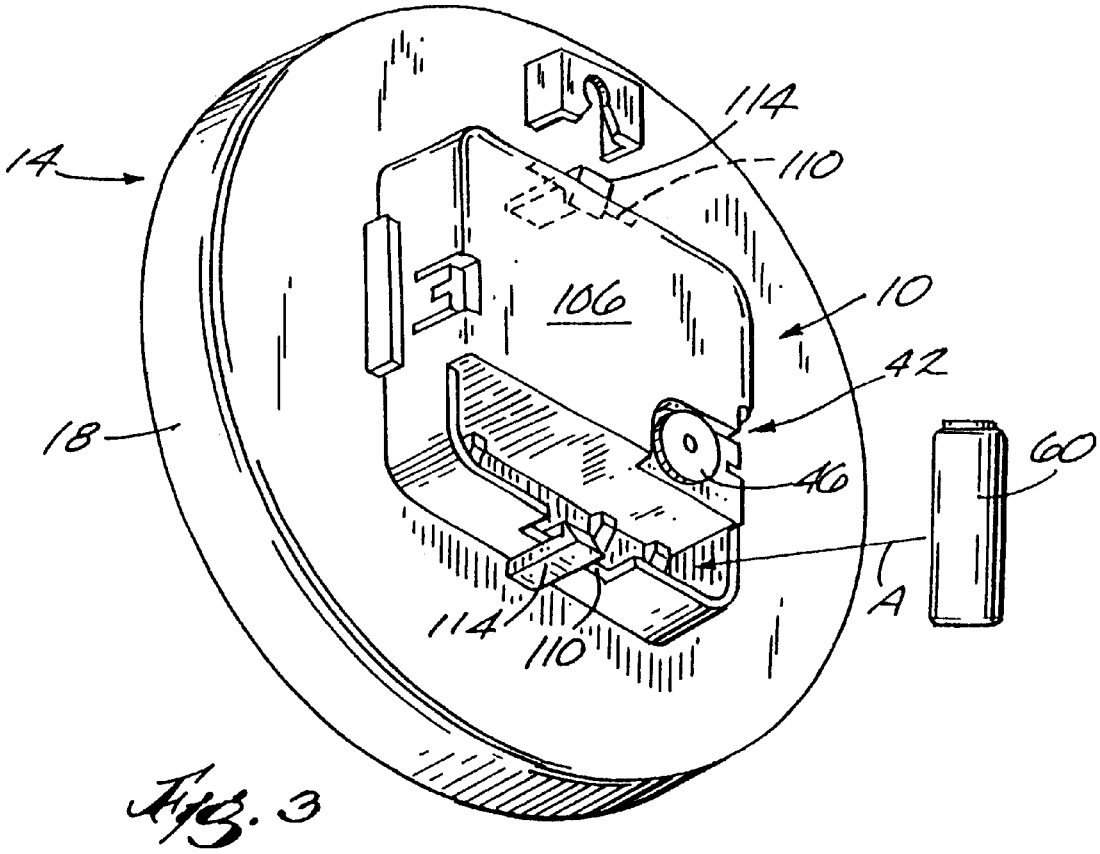
FIG. 3 is a rear perspective view illustrating the clockworks of FIGS. 1 and 2 and a timepiece embodying the present invention.

In the illustrated construction, if the switch 86 is operated and held in a closed position during connection of the battery 60, the automatic daylight savings time mode of the clockworks 10 will be deactivated. If the switch 86 is not operated as the power source 58 is connected, the daylight savings time mode will make automatic adjustments to the time registers 78 and 82. As shown in FIGS. 2 and 3, the clockworks 10 are housed as a unit in a cover portion 106 of the housing 18. The cover portion 106 is the same size (56 mm wide by 56 mm high by 17 mm thick) as the standard-sized cover portion designed for a standard quartz analog clockworks. Also, as with a standard cover portion, the battery 60 (see FIG. 3) is located horizontally at the bottom and is accessible from the back of the cover portion 106. In addition, the cover portion 106 defines standard-sized (15 mm wide) top and bottom ledges 110. The ledges 110 are engageable with retainers or hooks 114 formed on the rear of the housing portion 18 so that the clockworks 10 are connected to the clock 14.

In operation, the clockworks 10 are assembled as a unit (as shown in FIG. 2) and connected to the housing 18 (as shown in FIG. 3). The battery 60 is connected to power the drive mechanism 50 and the clockworks 10. As the battery 60 is connected, the operator selectively operates the switch to select the daylight savings mode.

The operator then positions the hands 30, 34 and 38 to the approximate current local time. After the approximate current local time is set, the operator selectively closes the switch 86 as the sweep hand 30 rotates by the indicator 26, preferably, corresponding to the 12 o'clock position. The operator then closes the switch 86 as the sweep hand 30 rotates by the minute hand 34. In the one construction, the clockworks 10 are now set so that the required information corresponding to the respective positions of the hands 30 and 34 is stored in the local time register 82. In the alternate construction, the operator also closes the switch 86 when the sweep hand 30 rotates by the hour hand 38 to store this position information in the local time register 82 The drive mechanism 50 rotatably drives the hands 30, 34 and 38 so that the clock 14 keeps accurate time from this initial set position.

In a remotely-controlled or radio-controlled clock, the broadcast time signal is received, processed and stored in the broadcast time register 78. If the information in the broadcast time register 78 does not agree with the information in the local time register 82, the driver 94 controls the motor 54 to advance the hands 30, 34 and 38 to positions corresponding to the broadcast time. The microprocessor 74 also advances the local time register 82 so that the information in the local time register 82 corresponds to the information in the broadcast time register 78.

If the switch 86 has not been operated to set the local time register 82 within a given time period (i.e., fifteen minutes) after the battery 60 is connected, the microprocessor 74 will automatically synchronize information in the local time register 82 with the information in the broadcast time register 78. The clockworks 10 will then operate to maintain the local time register 82 synchronized with the broadcast time register 78 and will advance the hands 30, 34 and 38, as necessary.

In the illustrated construction, before the clockworks 10 receives a broadcast time signal, the motor 54 advances the hands 30, 34 and 38 by double increments or steps on alternate seconds. While the broadcast time signal is being received but before the local time is synchronized with the broadcast time, the motor 54 advances the hands 30, 34 and 38 in a "high sweep mode", i.e., advancing the sweep hand 30 thirty-two steps per second. After the local time is synchronized with the broadcast time, the motor 54 will advance the hands 30, 34 and 38 a single step per second to indicate that the local time is synchronized with the broadcast time.

Various features of the invention are set forth in the following claims.

I claim:

1. A clockworks for use in a timepiece, the timepiece including a housing providing a face having indicators corresponding to respective time increments, and a plurality of hands rotatably supported on the face, the plurality of hands being rotatably positionable relative to the indicators to indicate a time, one of the plurality of hands being a sweep hand; said clockworks comprising:

a drive mechanism supported by the housing and connectable to the plurality of hands to rotatably drive the plurality of hands, said drive mechanism being connectable to a power source operable to power said drive mechanism, a time register to store information corresponding to the time indicated by the plurality of hands; and a switch member connected with said time register, said switch being operable when the sweep hand rotates by one of the indicators and when the sweep band rotates by an other one of the plurality of hands to provide the information to said time register corresponding to the time indicated by the plurality of hands.

2. The clockworks as set forth in claim 1 wherein said switch is operable by an operator, and wherein the operator selectively operates said switch when the sweep hand rotates by one of said indicators and when the sweep hand rotates by the other one of the plurality of hands.

3. The clockworks as set forth in claim 1 wherein the other one of the plurality of hands is a minute hand, and wherein said switch is operated when the sweep hand rotates by the minute hand.

4. The clockworks as set forth in claim 3 wherein a further one of the plurality of hands is an hour hand, and wherein said switch is operated when the sweep hand rotates by the hour hand to provide the information to said time register corresponding to the time indicated by the minute hand and the hour hand.

5. The clockworks as set forth in claim 3 wherein a further one of the plurality of hands is an hour hand, wherein said clockworks further comprises a mechanism for setting at least the hour hand in a rotational position, wherein an operator sets the hour hand in a predetermined rotational position, and wherein said switch is operated when the sweep hand rotates by the minute hand to provide the information to said time register corresponding to the time indicated by the minute hand.

6. The clockworks as set forth in claim 1 and further comprising:

a receiver for receiving a broadcast time signal;

a mechanism for comparing information corresponding to a broadcast time represented by the broadcast time signal to the information corresponding to the time indicated by the plurality of hands; and a mechanism for synchronizing the time indicated by the plurality of hands to the broadcast time.

7. The clockworks as set forth in claim 6 wherein said clockworks is adapted for use with a clock, wherein the housing includes a cover portion of a standard size adapted to cover a standard clockworks for the clock, and wherein said clockworks is supported by the housing and covered by the standard size cover portion.

8. The clockworks as set forth in claim 7 wherein the clock is a standard quartz analog clock, wherein the clock further includes a standard clockworks supportable by the housing and coverable by the standard size cover portion, the standard clockworks including a standard drive mechanism supportable by the housing and connectable to the plurality of hands to rotatably drive the plurality of hands, the drive mechanism being connectable to a power source operable to power the standard drive mechanism, and a mechanism for setting the plurality of hands in respective rotational positions, wherein said clockworks is removably substitutable for the standard clockworks.

9. The clockworks as set forth in claim 6 and further comprising an operator signaling mechanism operable to provide a representation of the broadcast time signal being received, and wherein said switch is operated to selectively deactivate said operator signaling mechanism.

10. The clockworks as set forth in claim 9 wherein, as the power source is connected to said drive mechanism, said switch is operated to deactivate the daylight savings mode.

11. The clockworks as set forth in claim 6 wherein, if, within a given time period, said switch is not operated to provide the information to said time register corresponding to the time indicated by the plurality of hands, information corresponding to the broadcast time will be provided to said local time register, and wherein, thereafter, said mechanism for synchronizing will maintain the information in said local time register synchronized with information corresponding to the broadcast time.

12. The clockworks as set forth in claim 1 wherein said clockworks has a daylight savings mode, and wherein said switch is operated to selectively deactivate the daylight savings mode.

13. A timepiece comprising:

a housing providing a face, said face having indicators corresponding to respective time increments;

a plurality of hands rotatably supported on said face, said plurality of hands being rotatably positionable relative to said indicators to indicate a time, one of said plurality of hands being a sweep hand; and a clockworks supported by said housing, said clockworks including a drive mechanism supported by said housing and connected to said plurality of hands to rotatably drive said plurality of hands, the drive mechanism being connectable to a power source operable to power said drive mechanism, a time register to store information corresponding to the time indicated by said plurality of hands, a switch member connected with said time register, said switch being operable when said sweep hand rotates by one of said indicators and when said sweep hand rotates by an other one of said plurality of hands to provide the information to said time register corresponding to the time indicated by said plurality of hands, means for receiving a broadcast time signal, means for comparing information corresponding to a broadcast time represented by the broadcast time signal to the information corresponding to the time indicated by said plurality of hands, and means for synchronizing the time indicated by said plurality of hands to the broadcast time.

14. The timepiece as set forth in claim 13 wherein said switch is selectively operable by an operator, and wherein the operator operates said switch when said sweep hand rotates by one of said indicators and when said sweep hand rotates by the other one of said plurality of hands.

15. The timepiece as set forth in claim 13 wherein the other one of said plurality of hands is a minute hand, and wherein said switch is operated when said sweep hand rotates by said minute hand.

16. The timepiece as set forth in claim 15 wherein a further one of said plurality of hands is an hour hand, and wherein said switch is operated when said sweep hand rotates by said hour hand to provide the information to said time register corresponding to the time indicated by said minute hand and said hour hand.

17. The timepiece as set forth in claim 15 wherein a further one of said plurality of hands is an hour hand, wherein said clockworks further includes a mechanism for setting at least said hour hand in a rotational position, wherein an operator sets said hour hand in a predetermined rotational position, and wherein said switch is operated when said sweep hand rotates by said minute hand to provide the information to said time register corresponding to the time indicated by said minute hand.

18. The timepiece as set forth in claim 13 wherein said housing includes a cover portion of a standard size adapted to cover a standard quartz analog clockworks, and wherein said clockworks is supported by said housing and covered by said standard size cover portion.

19. The timepiece as set forth in claim 13 wherein the clockworks has a daylight savings mode, and wherein said switch is operated to selectively deactivate the daylight savings mode.

20. The timepiece as set forth in claim 19 wherein, as the power source is connected to said drive mechanism, said switch is operated to deactivate the daylight savings mode.

21. The timepiece as set forth in claim 13 wherein, if, within a given time period, said switch is not operated to provide the information to said time register corresponding to the time indicated by the plurality of hands, information corresponding to the broadcast time will be provided to said local time register, and wherein, thereafter, said means for synchronizing will maintain the information in said local time register synchronized with information corresponding to the broadcast time.

22. A method for operating a timepiece, the timepiece including a housing providing a face, the face having indicators corresponding to respective time increments, a plurality of hands rotatably supported on the face, the plurality of hands being rotatably positionable relative to the indicators to indicate a time, one of the plurality of hands being a sweep hand, and a clockworks supported by the housing, the clockworks including a drive mechanism supported by the housing and connected to the plurality of hands to rotatably drive the plurality of hands, the drive mechanism being connectable to a power source operable to power the drive mechanism, a time register to store information corresponding to the time indicated by the plurality of hands, and a switch member connected with the time register, said method comprising:

connecting the drive mechanism to the power source;

operating the switch when the sweep hand rotates by one of the indicators; and operating the switch when the sweep hand rotates by an other one of the plurality of hands to provide the information to the time register corresponding to the time indicated by the plurality of hands.

23. The method as set forth in claim 22 wherein the timepiece further includes a receiver for receiving a broadcast time signal, means for comparing information corresponding to a broadcast time represented by the broadcast time signal to the information corresponding to the time indicated by the plurality of hands, and means for synchronizing the time indicated by the plurality of hands to the broadcast time, and wherein said method further comprises:

receiving the broadcast time signal;

comparing the information corresponding to the broadcast time to the information corresponding to the time indicated by the plurality of hands; and synchronizing the time indicated by the plurality of hands to the broadcast time.

24. The method as set forth in claim 23 wherein the clockworks further includes an operator signaling mechanism operable to provide a representation of the broadcast time signal being received, and wherein said method further comprises operating said switch to s electively deactivate said operator signalling mechanism.

25. The method as set forth in claim 22 wherein the clockworks has a daylight savings mode, and wherein said method further comprises operating the switch to selectively deactivate the daylight savings mode.

26. The method as set forth in claim 25 wherein, as the drive mechanism is connected to the power source, the switch is operated to deactivate the daylight savings mode.

* * * * *